United States Patent [19]

Ahs

[11] Patent Number: 4,968,417

[45] Date of Patent: Nov. 6, 1990

[54] APPARATUS FOR SCREENING A SUSPENSION OF FIBROUS CELLULOSE PULP

[75] Inventor: Björn Åhs, Karlstad, Sweden

[73] Assignee: Kamyr AB, Karlstad, Sweden

[21] Appl. No.: 357,289

[22] Filed: May 26, 1989

[30] Foreign Application Priority Data

Jun. 16, 1988 [SE] Sweden ..... 8802251

[51] Int. Cl.[5] ..... B07B 1/20

[52] U.S. Cl. ..... 209/273; 209/300

[58] Field of Search ..... 209/270, 273, 288–292, 209/300, 303–306

[56] References Cited

U.S. PATENT DOCUMENTS

| | | | |
|---|---|---|---|
| 817,333 | 4/1906 | Orrman | 209/273 |
| 1,537,691 | 5/1925 | Priem | 209/273 |
| 3,223,239 | 12/1965 | Dick | 209/273 X |
| 3,545,621 | 12/1970 | Lamort | 209/273 X |
| 3,786,918 | 1/1974 | Holz | 209/273 |
| 3,898,157 | 8/1975 | Hooper | 209/273 X |
| 4,543,181 | 9/1985 | Greenwood | 209/273 |
| 4,601,819 | 7/1986 | Pellhammer et al. | 209/273 |
| 4,680,108 | 7/1987 | Ahs | 209/273 |
| 4,911,828 | 3/1990 | Musselmann et al. | 209/273 |
| 4,913,806 | 4/1990 | Hillstrom et al. | 209/273 |

*Primary Examiner*—Margaret A. Focarino
*Assistant Examiner*—Edward M. Wacyra
*Attorney, Agent, or Firm*—Nixon and Vanderhye

[57] ABSTRACT

An apparatus for screening a suspension of fibrous cellulose pulp comprising a housing and a rotor shaft, the housing having an inlet for the suspension and containing first and second screening sections, each comprising a rotor member mounted on the rotor shaft and a cylindrical screen cooperating therewith and defining an outer accept chamber and an inner screening chamber, the first screening section including an inlet chamber communicating with the screening chamber of the first screening section, and an outlet chamber communicating with the screening chamber of the first screening section, for discharging a first reject, and the second screening section including an outlet chamber communicating with the screening chamber of the second screening section, for discharging a second reject from the apparatus, and the accept chamber of the second screening section having an outlet for discharging screened fiber suspension. The outlet chamber of the first screening section includes an outlet disposed for discharging the first reject from the apparatus, and the accept chamber of the first screening section is in open communication with the screening chamber of the second screening section via an interior connection for conveying the fiber suspension screened in the form of an accept in the first screening section to the second screening section to be re-screened, the outlet from the accept chamber being disposed for discharging repeatedly screened fiber suspension in the form of a final accept.

15 Claims, 2 Drawing Sheets

APPARATUS FOR SCREENING A SUSPENSION OF FIBROUS CELLULOSE PULP

FIELD AND BACKGROUND OF THE INVENTION

The present invention relates to an apparatus for screening a suspension of fibrous cellulose pulp, comprising an elongate housing and a rotor shaft extending therethrough.

Screening apparatuses for screening pulps are known through, for instance, U.S. Pat. Nos. 4,680,108 and 817,333. However, the screening apparatus disclosed in U.S. Pat. No. 4,680,108 includes two screening sections which are located close to each other and the intention is to extract two different accepts from the screening apparatus. The apparatus described in U.S. Pat. No. 817,333 consists of two parts spaced from each other, each having a cylindrical casing or housing. Again, the intention is to extract and discharge an accept from each part of the apparatus, the reject or tailings from the first part being used as inject in the second part.

In order to screen an accept from a screening apparatus once again, or a further number of times, a plurality of separate screening apparatuses have hitherto been used, disposed one after the other and driven individually. Such an installation is expensive, requires considerable space and the power consumption is high. Furthermore, the instrumentation required for flow-measurement is relatively extensive.

SUMMARY OF THE INVENTION

The object of the present invention is to provide a screening apparatus constituting a compact, i.e. space saving unit containing at least two screening sections for screening an accept obtained from the immediately preceding screening section of the compact unit, the rotor members being driven by a common rotor shaft, thus reducing the power consumption. The flow-measurement instrumentation will thus be simpler since it need only be mounted for the reject and accept leaving the screening apparatus.

The present invention refers to an apparatus for screening a suspension of fibrous cellulose pulp, said apparatus comprising an elongate housing and a rotor shaft extending therethrough, said housing having an inlet for said suspension and containing at least first and second screening sections, each comprising a rotor member mounted on the rotor shaft and a cylindrical screening means cooperating therewith and defining an outer accept chamber and an inner screening chamber, the first screening section including an inlet chamber communicating with the screening chamber of the first screening section, and an outlet chamber communicating with the screening chamber of the first screening section, for discharging a first reject, and the second screening section including an outlet chamber communicating with the screening chamber of the second screening section, for discharging a second reject from the apparatus, and the accept chamber of the second screening section having an outlet for discharging screened fiber suspension, the outlet chamber of the first screening section including an outlet disposed for discharging the first reject from the apparatus, the accept chamber of the first screening section being in open communication with the screening chamber of the second screening section via a connecting means for conveying the fiber suspension screened in the form of an accept in the first screening section to the second screening section via a connecting means for conveying the fiber suspension screened in the form of an accept in the first screening section to the second screening section to be re-screened, the outlet from the accept chamber of the second screening section being disposed for discharging repeatedly screened fiber suspension in the form of a final accept.

BRIEF DESCRIPTION OF THE DRAWINGS

The invention will be described in the following, with reference to the accompanying drawings.

DETAILED DESCRIPTION OF THE DRAWINGS

Figure 1:
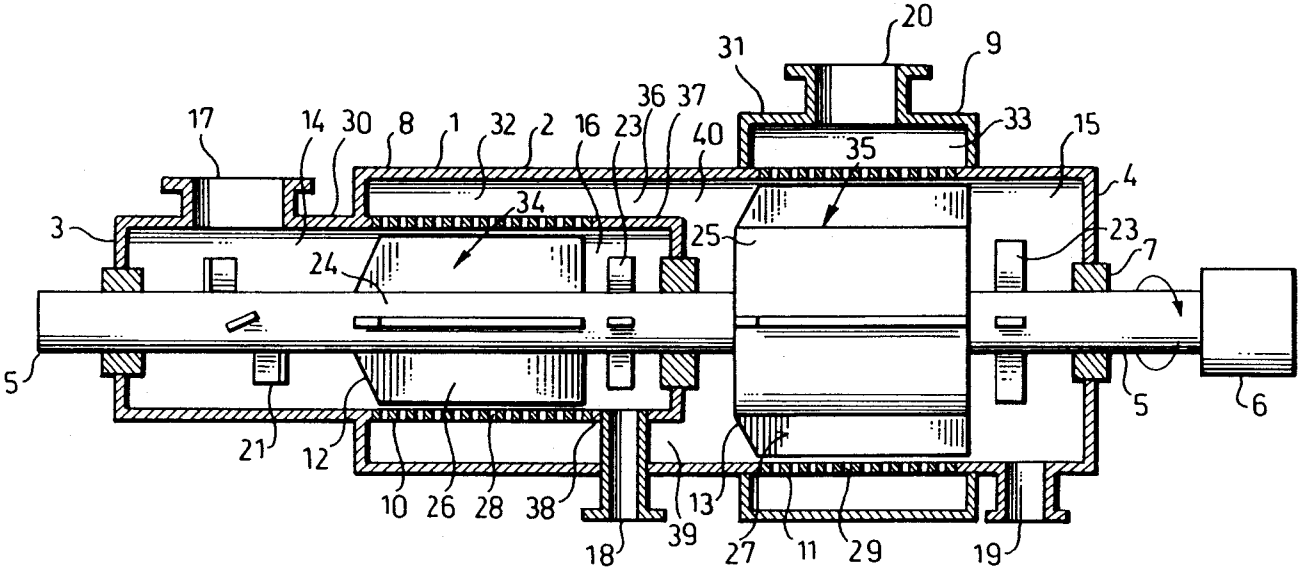
FIG. 1 shows schematically, and partially in longitudinal section, a screening apparatus according to a first embodiment of the invention.

Referring to FIG. 1, this shows schematically a screening apparatus comprising an elongate housing 1 formed substantially by an outer cylindrical wall 2 and two end walls 3, 4. The screening apparatus includes an elongate horizontal rotor shaft 5, extending through the end walls 3, 4 and provided at one end with a suitable drive device 6 to rotate the rotor shaft 5 in the direction indicated by an arrow. Suitable bearing and sealing units 7 are arranged on the rotor shaft 5 to seal against the end walls 3, 4. The screening apparatus is supported by a stand having outer bearings (not shown) for the two end portions of the rotor shaft 5 located outside the housing 1.

The housing 1 is divided into a first screening section 8 and a second screening section 9 disposed axially after the first one. Each screening section includes a screening means 10, 11 and a rotor member 12, 13. The first screening section 8 is provided with an inlet chamber 14 disposed close to one end wall 3, while the other screening section 9 is provided with an outlet chamber 15 disposed close to the other end wall 4.

According to the present invention the first screening section 8 also includes an outlet chamber 16.

The housing 1 is provided with an inlet 17 connected to the inlet chamber 14, for the fiber suspension which is to be screened, i.e. the inject, an outlet 18 connected to the outlet chamber 16 of the first screening section 8 for the remaining fraction after a first primary screening, i.e. the first reject, an outlet 19 connected to the outlet chamber 15 of the second screening section 9 for the remaining fraction after a second primary screening, i.e. the second reject, and an outlet 20 connected to the second screening section 9 for the finer fraction screened off, i.e. the final accept.

Within the inlet chamber 14 the rotor shaft 5 is provided with a plurality of vanes 21, e.g. four vanes as shown, the vanes being designed to feed the fiber suspension (inject) entering through the inlet 17, axially forward into the first screening section 8. In each outlet chamber 15, 16, the rotor shaft 5 is provided with a plurality of vanes 22, 23, e.g. four vanes as shown, which are designed to discharge the fraction remaining after respective primary screening, i.e. the first reject and second reject, respectively, in radial direction out of the screening apparatus. Special impellers may alternatively be mounted on the rotor shaft 5 in each outlet chamber 15, 16.

Each rotor member 12, 13 includes a cylindrical, central body 24, 25 and a plurality of protrusions 26, 27 attached to the cylindrical body 24, 25, respectively, and which may consist of ribs, vanes or, as shown in the drawings, blades. Four blades 26, 27 are used in the embodiment shown, but the number may vary depending on the capacity of the screening apparatus, the screening properties of the fiber suspension, etc.

Each screening means 10, 11 consists of a screening plate disposed concentrically with the rotor shaft 5 and having suitable screening openings 28, 29 in the form of holes or slits, through which the finer fraction of the fiber suspension is separated in the form of first accept and final accept, respectively. The screening plate 10 of the first screening section 8 is attached by its upstream end to the cylinder wall 2 at a radially indented portion 30 thereof, said portion 30 thus surrounding the inlet chamber 14. In the embodiment shown in FIG. 1, the screening plate 11 of the second screening section 9 is attached by its opposite ends to the cylinder wall 2 at a radially extended portion 31 thereof.

Each screening plate 10, 11 defines outwardly an annular accept chamber 32, 33, respectively, between itself and the cylinder wall 2, and inwardly an annular screening chamber 34, 35, respectively between itself and the central body 24, 25 on the rotor shaft 5.

The blades 26, 27 of the rotors 12, 13 extend along the cylindrical body 24, 25 and radially outwards from this to the vicinity of respective screening plate 10, 11 so that a suitably small space is formed between the longitudinal, outer free edge of each blade 26, 27 and the inside of the screen plate 10, 11, thus ensuring that the blades 26, 27 pass along the cylindrical, inner screen faces of the screening plates 10, 11 without coming into contact therewith, during rotating of the rotor shaft 5. In the embodiment shown in FIG. 1 the blades 26, 27 have an axial extension along the rotor shaft 5 within the regions of the screening plates 10, 11. Alternatively the blades may be inclined in suitable manner, extending helically along the rotor shaft, being directed to affect feeding of the fiber suspension in axial direction in addition to radial direction.

Each screening chamber 34, 35 is axially in direct, i.e. open, communication downstream with the outlet chamber 16 and 15, respectively. The accept chamber 32 of the first screening section 8 is in open communication with the screening chamber 35 of the second screening section 9 via an interior connecting means 36 which, in the embodiment shown in FIG. 1, extends axially between the cylinder wall 2 and an inner partition 37 and a small portion of the rotor shaft 5. The inner partition 37 thus defines and encompasses the outlet chamber 16 of the first screening section 8 and has a cylindrical portion 38 with preferably the same diameter as the screening plate 10. This portion 38 may be formed of a tight extension of the screening plate 10. According to the embodiment shown in FIG. 1, the connecting means 36 comprises an annular space 39 surrounding said cylindrical portion 38 of the partition 37, and thereafter an inlet chamber 40 to the screening chamber 35 of the second screening section 9.

In the embodiment shown in FIG. 1 the cylindrical body 25 of the second screening section 9 has a larger diameter than the cylindrical body 24 of the first screening section 8 and the outer, free edges of the rotor blades 27 in the second screening section 9 are at a radially greater distance from the rotor shaft 5 than is the case for the rotor blades 26 in the first screening section 8. The first-mentioned rotor blades 27 thus acquire greater peripheral speed than the last-mentioned blades 26. In this embodiment, therefore, the accept chamber 33 of the second screening section 9 is located at a greater radial distance from the rotor shaft 5 than the accept chamber 32 of the first screening section 8.

Figure 2:
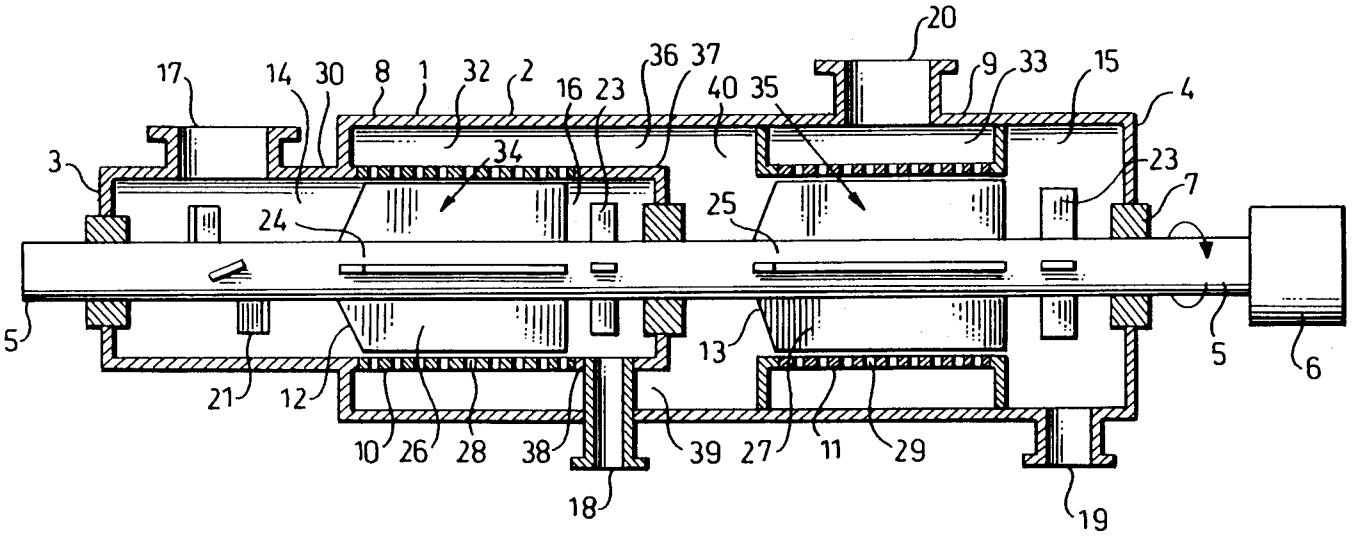
FIG. 2 shows schematically, and partially in longitudinal section, a screening apparatus according to a second embodiment of the invention.

FIG. 2 shows another embodiment of a screening apparatus according to the invention. In this embodiment the screening apparatus is very similar to that in FIG. 1, the only difference being the design of the second screening section. The same reference numerals are therefore used in FIG. 2 as in FIG. 1. In the screening apparatus shown in FIG. 2 the accept chamber is thus located in the housing 1 without enlargement of the cylinder wall 2. The two accept chambers 32, 33 are thus located at the same radial distance from the rotor shaft 5. Further, the two screening plates 10, 11 have the same radial extension, as is the case for the two rotor members 12, 13. If desired, however, the two cylindrical bodies 24, 25 of the rotor shaft 5 may have different diameters. In each case the screening chambers 34, 35 of the two screening sections 8, 9 are axially aligned with each other. In this embodiment, therefore, the rotor blades 26, 27 of the two rotor members 12, 13 have the same peripheral speed, which is generally to be preferred. Furthermore, the location of the accept chamber 33 of the second screening section 9 closer to the rotor shaft 5 also saves space.

The screening apparatuses described are particularly suitable for double-screening pulp of medium concentration, i.e. about 6–15%. During operation the screening apparatus is in each case completely filled with the fiber suspension which flows through the apparatus under pressure. The rotor shaft 5 is driven so that the rotor blades 26 in the first screening section 8 in the apparatus according to FIG. 1, and the rotor blades 26, 27 in the two screening sections 8, 9 in the apparatus according to FIG. 2, acquire a peripheral speed of about 20–25 m/sec. The rotor blades 26, 27 will thus pass along the cylindrical, inner screen faces of the screening plates 10, 11 at a sufficiently high speed for the fiber suspension to be subjected to shearing forces and pulsations, resulting in turbulences. The fiber suspension is by these effects converted to a fluidized state, i.e. an easy-flowing state, in which the fibers can move more easily in relation to each other.

The screening apparatuses described herein constitute compact units for double-screening in a first primary screen and a second primary screen, which has previously required two separate screening apparatuses, each with its own drive means. The fiber suspension supplied, i.e. the inject, flows through the inlet chamber 14 and into the screening chamber 34 of the first screening section, wherein the rotor blades 26, cooperating with the screening plate 10, affect the fiber suspension so that the fiber suspension is fluidized at the same time as the fiber bundles are broken down. The reject from the first screening section 8 is fed through the outlet 18 to a device for specific treatment, while the first accept obtained is forced through the open connecting means 36 and further into the second screening section 9 to be subjected in similar manner to a second primary screening. The second or final accept is fed out through the accept outlet 20 for further treatment in the process line, while the rejects from the two primary screenings are withdrawn from the screening apparatus, preferably for specific treatment enabling additional accept to be recovered.

That which is claimed:

1. An apparatus for screening a suspension of fibrous cellulose pulp, comprising: an elongate housing and a rotor shaft, defining an axis of rotation, extending therethrough;

said housing having an inlet for said suspension and containing at least first and second screening sections;

each screening section comprising a rotor member mounted on the rotor shaft and a cylindrical screening means cooperating therewith and defining an outer accept chamber and an inner screening chamber; the first screening section including an inlet chamber communicating with the screening chamber of the first screening section, and an outlet chamber communicating with the screening chamber of the first screening section, for discharging a first reject;

the second screening section including an outlet chamber communicating with the screening chamber of the second screening section, for discharging a second reject from the apparatus, and the accept chamber of the second screening section having an outlet for discharging screened fiber suspension;

the first and second screening sections disposed axially in line and spaced from each other along the axis of rotation of the rotor shaft;

the outlet chamber of the first screening section including an outlet disposed for discharging the first reject from the apparatus, the accept chamber of the first screening section being in open communication with the screening chamber of the second screening section;

a connecting means for conveying the fiber suspension screened in the form of an accept in the first screening section to the second screening section to be re-screened; and the outlet from the accept chamber of the second screening section being disposed for discharging repeatedly screened fiber suspension in the form of a final accept.

2. An apparatus as claimed in claim 1 wherein said connecting means includes an annular space located in the housing, the space being radially inwardly separated by a substantially cylindrical portion of a partition, from the outlet chamber of the first screening section.

3. An apparatus as claimed in claim 2 wherein the connecting means further comprises an inlet chamber located between said annular space and the screening chamber of the second screening section.

4. An apparatus as claimed in claim 1 wherein the outlet from the outlet chamber of the first screening section comprises at least one, substantially radially directed pipe connection.

5. An apparatus as claimed in claim 1 wherein each rotor member comprises a plurality of blades, extending along the rotor shaft and extending radially outwardly therefrom so that the outer, longitudinal, free edge of the blades is located close to the screen face of the screening means but without touching it.

6. An apparatus as claimed in claim 1 wherein the accept chamber of the second screening section is located at a radially greater distance from the rotor shaft than the accept chamber of the first screening section, the outer, free edges of the rotor blades being located at a greater radial distance from the rotor shaft within the second screening section than within the first screening section.

7. An apparatus as claimed in claim 1 wherein the accept chambers of the two screening sections are located at substantially the same radial distance from the rotor shaft.

8. An apparatus as claimed in claim 1 in combination with a closed pressure system.

9. Apparatus as recited in claim 1 further comprising means for rotating said shaft at a velocity sufficient to fluidize medium consistency pulp.

10. An apparatus for screening a suspension of fibrous cellulose pulp, comprising:

an elongate housing and a rotor shaft extending therethrough;

said housing having an inlet for said suspension and containing at least first and second screening sections;

each screening section comprising a rotor member mounted on the rotor shaft and a cylindrical screening means cooperating therewith and defining an outer accept chamber and an inner screening chamber;

the accept chambers of the first and second screening sections being located at substantially the same radial distance from the rotor shaft, the screening chamber of the first screening section being axially in line with the screening chamber of the second screening section;

the first screening section including an inlet chamber communicating with the screening chamber of the first screening section, and an outlet chamber communicating with the screening chamber of the first screening section, for discharging a first reject;

the second screening section including an outlet chamber communicating with the screening chamber of the second screening section, for discharging a second reject from the apparatus, and the accept chamber of the second screening section having an outlet for discharging screened fiber suspension;

the outlet chamber of the first screening section including an outlet disposed for discharging the first reject from the apparatus, the accept chamber of the first screening section being in open communication with the screening chamber of the second screening section;

a connecting means for conveying the fiber suspension screened in the form of an accept in the first screening section to the second screening section to be re-screened; and the outlet from the accept chamber of the second screening section being disposed for discharging repeatedly screened fiber suspension in the form of a final accept.

11. Apparatus as recited in claim 10 further comprising means for rotating said shaft at a velocity sufficient to fluidize medium consistency pulp.

12. An apparatus as claimed in claim 10 wherein said connecting means includes an annular space located in the housing, the space being radially inwardly separated by a substantially cylindrical portion of a partition, from the outlet chamber of the first screening section.

13. An apparatus as claimed in claim 12 wherein the connecting means further includes an inlet chamber located between said annular space and the screening chamber of the second screening section.

14. An apparatus as claimed in claim 10 wherein the outlet from the outlet chamber of the first screening section comprises at least one, substantially radially directed pipe connection.

- 15. An apparatus as claimed in claim 10 wherein each rotor member comprises a plurality of blades extending along the rotor shaft and extending radially outwardly therefrom so that the outer, longitudinal, free edge of the blades is located close to the screen face of the screening means but without touching it.

* * * * *